US005648843A

United States Patent [19]

Eguchi

[11] Patent Number: 5,648,843

[45] Date of Patent: Jul. 15, 1997

[54] AUTOMATIC DUPLEX IMAGE FORMING APPARATUS HAVING AN ADJUSTING DRIVING MECHANISM

[75] Inventor: Takeshi Eguchi, Saitama-ken, Japan

[73] Assignee: Kabushiki Kaisha Toshiba, Kawasaki, Japan

[21] Appl. No.: 598,438

[22] Filed: Feb. 8, 1996

[30] Foreign Application Priority Data

Mar. 22, 1995 [JP] Japan ..... 7-062492

[51] Int. Cl.[6] ..... G03G 15/00

[52] U.S. Cl. ..... 399/364; 271/3.17; 399/38

[58] Field of Search ..... 355/208, 311, 355/318, 319; 271/3.17, 265.01

[56] References Cited

U.S. PATENT DOCUMENTS 4,655,582 4/1987 Okuda et al. ..... 355/319
5,113,221 5/1992 Kotani et al. ..... 355/208
5,428,434 6/1995 Hirao ..... 355/208 X

FOREIGN PATENT DOCUMENTS 4-89737 3/1992 Japan .
5-24680 2/1993 Japan .

*Primary Examiner*—Arthur T. Grimley
*Assistant Examiner*—Sophia S. Chen
*Attorney, Agent, or Firm*—Foley & Lardner

[57] ABSTRACT

An image forming apparatus includes an image forming unit for forming an image on an image receiving medium which has first and second surfaces, a roller for conveying the image receiving medium on which the image was formed on the first surface to the image forming unit again, the roller contacts at least the first surface of the image receiving medium, and a driving mechanism for driving the roller. The apparatus further includes a detector for detecting the density of the image formed on the first surface of the image receiving medium. The driving condition of the roller by the driving mechanism is adjusted according to the image density detected by the detector.

20 Claims, 9 Drawing Sheets

AUTOMATIC DUPLEX IMAGE FORMING APPARATUS HAVING AN ADJUSTING DRIVING MECHANISM

BACKGROUND OF THE INVENTION

1. Field of the Invention

The present invention is related to an image forming apparatus and, more particularly, to an image forming apparatus which is capable of forming an image on the back of an image receiving medium of which a front surface has another image formed thereon.

2. Description of the Related Art

As an image forming apparatus, a copying machine equipped with an automatic duplex device is known. When forming images on both sides of a paper by this copying machine, an image is first formed on the surface of a paper supplied from a paper supply cassette, etc. by an image forming unit. Then, the paper on which front surface an image is formed is stacked in a temporary stacker of the automatic duplex device after passing through a fixing unit. The stacked paper is taken out of the temporary stacker and supplied to the image forming unit again in the inverted state and then, another image is formed on the back of the paper by the image forming unit.

In general, the automatic duplex device is provided with a pick up roller to pick up a paper from the temporary stacker, a feed roller to supply the picked up paper, and an aligning roller pair to align the leading edge of supplied paper and supply it to the image forming unit at a prescribed timing. A paper is stacked in the temporary stacker in the state with the image formed surface facing upward, and the pick up roller and the feed roller convey the paper by contacting its image formed surface.

When conveying a paper by having the feed roller contact its image formed surface as described above, the coefficient of friction between the feed roller and a paper changes corresponding to the density of an image formed on the paper surface. That is, if a fully black image in high image density or an image in high half tone was formed on a paper, a quantity of developer adhered to the paper is much more than an image in the low image density like an image having much white portion. So, the surface of a paper with a high image density has the small coefficient of friction and is in the slippery state.

However, on a conventional image forming apparatus, such paper supply conditions of a feed roller as a driving speed, a driving time, etc. are always set at constant levels regardless of the image density formed on a paper. Therefore, when a paper on which an image formed in the low image density and having the relatively high coefficient of friction is supplied by the feed roller, the amount of feeding operation of the paper to be supplied to the aligning roller becomes much more than a specified amount of feeding operation. In this case, the leading edges of the paper are deflected and a transfer void, paper jam, etc. tend to occur. On the contrary, when a paper with a high density image is formed and the relatively low coefficient of friction is supplied by the feed roller, the amount of feeding of the paper to be supplied to the aligning roller becomes less than a specified amount, causing an insufficient aligning. As a result, the slippage of the leading edges of paper, paper jamming, etc. tend to occur.

SUMMARY OF THE INVENTION

It is an object of the present invention to provide an image forming apparatus which is capable of forming an image satisfactorily on the back of a paper on which front surface another image is already formed without being affected by the image density formed on the paper.

According to the present invention, there is provided an image forming apparatus comprising means for forming an image on an image receiving medium which has a first and a second surfaces; means for conveying the image receiving medium on which the image was formed on the first surface to the image forming means again, the conveying means contacts at least the first surface of the image receiving medium; means for driving the conveying means; means for detecting the density of the image formed on the first surface of the image receiving medium; and means for adjusting the driving conditions of the conveying means by the driving means according to the image density detected by the detecting means.

DETAILED DESCRIPTION OF THE PREFERRED EMBODIMENTS

Figure 1:
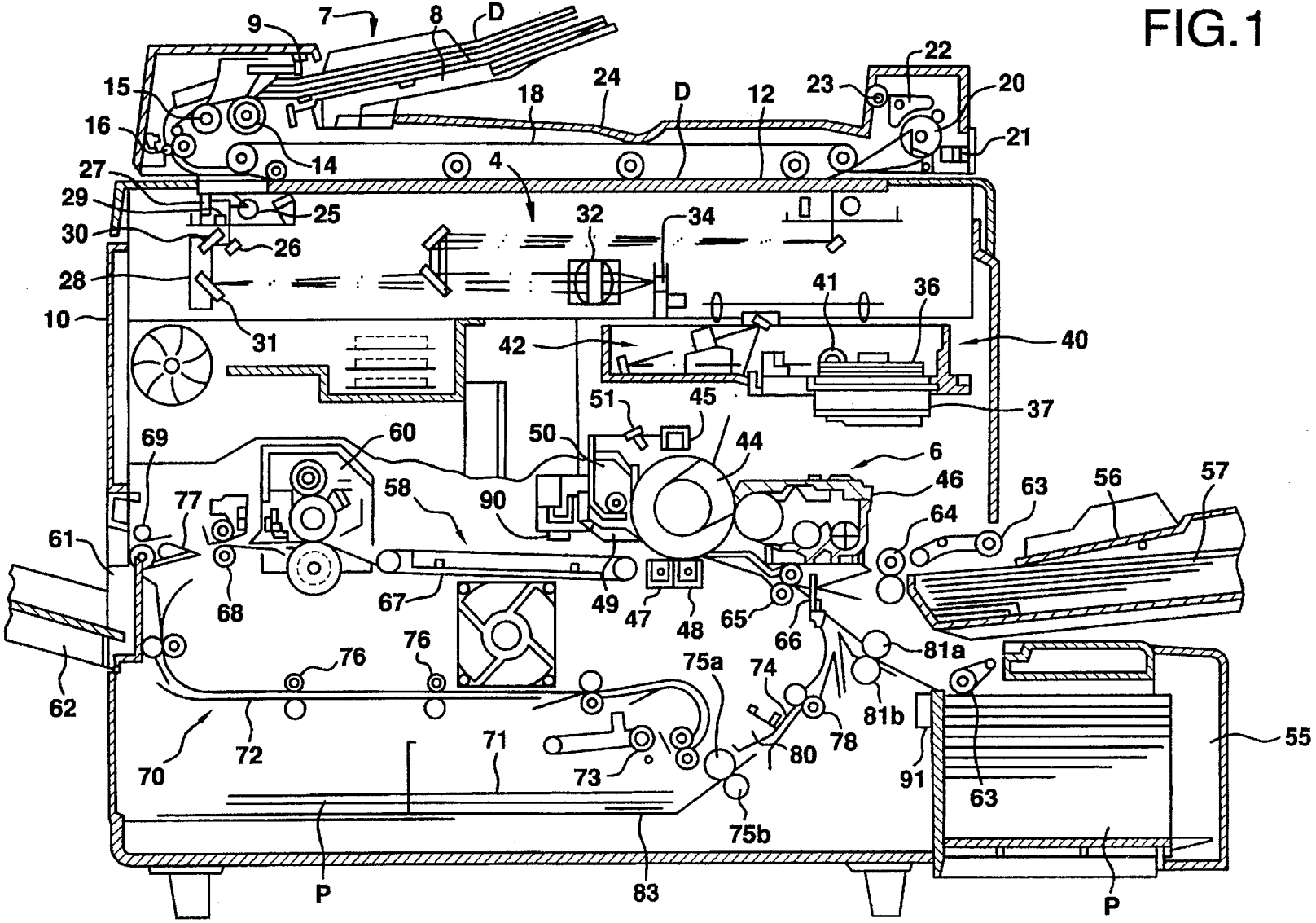
FIG. 1 is a sectional view of a copying machine shown as an embodiment of an image forming apparatus of the present invention.

Referring now to the attached drawings, an image forming apparatus of the present invention will be described in detail regarding embodiments applied to a copying machine which uses digital signals for image information corresponding to original documents, As shown in FIG. 1, a copying machine is equipped with a main body 10, and in the inside of the main body 10, there are provided a scanner 4 to read an image from an original document and an image forming unit 6 which functions as an image forming means.

On the top of the main body 10, there are a control panel (not shown) and a document table 12 comprising a transparent glass on which an original document D is placed. Further, an automatic document feeder 7 (hereinafter referred to as ADF) is provided on the top of the main body 10 to automatically feed an original document on the document table 12. The ADF 7 is able to open/close to the document table 12 and also functions as a document retainer to bring the document D closely contact to the document table 12.

The ADF 7 is equipped with a document tray 8 on which original documents D are set, an empty sensor 9 to detect presence of original documents, a pick up roller 14 to taken out original documents one by one from the document tray 8, a document feed roller 15 to convey the picked up document, an aligning roller pair 16 to align the leading edges of documents, and a conveyor belt 18 which is arranged to cover almost the entire document table. A plurality of documents D that are set facing upward on the document tray 8 are taken out from the lowest page, that is, the last page by the pick up roller 14. The taken out documents D are conveyed to the prescribed position on the document table 12 by the conveyor belt 18 after the leading edges are aligned by the aligning roller pair 16.

On the ADF 7, an inverting roller 20, a discharge/invert sensor 21, a flapper 22 and an exit roller 23 are arranged at the end opposite to the aligning roller pair 16 with the conveyor belt 18 put between them. The original documents D, when image information was read therefrom by the scanner 4, which will be described later, are sent out from the top of the document table 12 by the conveyor belt 18 and are ejected on a document receiving tray 24 on the top of the ADF 7 via the inverting roller 20, the flapper 22 and the exit roller 23. When reading the back of the document D, the document D conveyed by the conveyor belt 18 is inverted by the inverting roller 20 when the flapper 22 is changed over, and is conveyed to the prescribed position on the document table again by the conveyor belt 18.

The scanner 4 provided in the main body 10 has a light source 25 such as a fluorescent lamp, etc. to illuminate the document D placed on the document table 12 and a first mirror 26 which deflects the reflecting light from the document D in the prescribed direction. The light source 25 and the first mirror 26 are mounted to a first carriage 27 provided under the document table 12. The first carriage 27 is provided movable in parallel with the document table 12 and is reciprocated under the document table 12 by the driving motor via a toothed belt (not shown), etc.

Under the document table 12, there is a second carriage 28 which is movable in parallel with the document table. A second and a third mirrors 30 and 32., which deflect the reflecting light from the document D deflected by the first mirror 26, is mounted at a right angle to each other. The second carriage 28 is moved following the first carriage 27 by the toothed belt which drives the first carriage 27, etc. and is moved in parallel with the first carriage at a ½ speed along the document table.

Further, under the document table 12 there are an imaging lens 32 to focus the reflecting light from the third mirror 31 on the second carriage 28 and a CCD sensor 34 for receiving and photoelectrically converting the reflecting light focused by the imaging lens 32. The imaging lens 32 is provided movably via a driving mechanism in the face including the light axis deflected by the third mirror 31 and focuses the reflecting light at a desired magnification. The CCD sensor 34 photoelectrically converts the input reflecting light and outputs electric signals corresponding to read original documents D.

The image forming unit 6 is equipped with a laser exposing unit 40. This laser exposing unit 40 is equipped with a semiconductor laser 41 which is used as a light source, a polygonal mirror 36 which continuously deflects the laser beam projected from the semiconductor laser a motor 37 to drive the polygonal mirror 36 at a prescribed speed, and a deflecting optical system 42 which deflects the laser beam from the polygonal mirror 36 and leads it to a photosensitive drum 44 which will be described later.

The semiconductor laser 41 is turned ON/OFF corresponding to image information of original documents D read by the scanner 4 or facsimile transmitted/received document information, etc. and this laser beam is directed to the photosensitive drum 44 via the polygonal mirror 36 and the deflecting optical system 42. When the laser beam directed to the photosensitive drum 44 scans the peripheral surface of the photosensitive drum, an electrostatic latent image is formed on the peripheral surface of the photosensitive drum 44.

Further, the image forming unit 6 has the rotatable photosensitive drum 44 as an image carrier provided nearly at the center of the main body 10. Around the photosensitive drum 44, there are a main charger 45 which charges the peripheral surface of the photosensitive drum 44 to a prescribed charge and a developing unit 46 which develops an electrostatic latent image formed at the exposing position on the peripheral surface of the photosensitive drum at a desired image density by supplying a toner that is as a developer. In addition, around the photosensitive drum 44 there are also a transfer charger 48 which transfers a toner image formed on the photosensitive drum 44 onto image receiving media, that is the paper P supplied from a paper cassette, which will be described later, a separation charger 47 which is formed in one unit with the transfer charger 48 and separates the paper P from the photosensitive drum 44, and a separation claw 49 which separates the paper P from the photosensitive drum 44. Further, around the photosensitive drum 44, a cleaning unit 50 to clean a toner remained on the peripheral surface of the photosensitive drum 44 and a charge elimination unit 51 to eliminate charge from the peripheral surface of the photosensitive drum 44 are arranged in order.

There is a large volume paper feeder 55 provided on the side wall of the main body 10. In the large volume paper feeder 55, paper of high using frequency, for instance, A4 size paper of about 3,000 sheets is accommodated. Further, a paper supply cassette 57 which also serves as a manual paper feed tray 56 are mounted detachably above the large volume paper feeder 55.

In the main body 10, a conveying path 58 is formed, which is extending from the paper supply cassette 57 and the large volume paper feeder 55 passing through a transferring stage positioned between the photosensitive drum 44 and the transfer charger 48. At the end of this conveying path 58, a fixing unit 60 is arranged. On the side wall of the main body 10 opposite to the fixing unit 60, an exhaust port 61 is formed and a receiving tray 62 is provided thereto.

A pick up roller 63 is provided near the paper supply cassette 57 and the large volume paper feeder 55, respectively to pick up paper one by one from the cassette or the large volume paper feeder 55. In addition, a feed roller 64 is provided to the conveying path 58 to convey the paper P picked up from the paper supply cassette 57 by the pick up roller 63 through the conveying path 58. Further, there are a feed roller 81*a* and a separation roller 81*b*, the feed roller 81*a* conveys the paper P picked up from the large volume paper feeder 55 by the pick up roller 63 through the conveying path 58 and the separation roller 81*b* rotatably contacts the feed roller 81*a*.

At the upper stream side of the photosensitive drum 44, an aligning roller pair 65 is provided to the conveying path 58.

The aligning roller pair 65 corrects the tilted paper P supplied by the feeder roller 64 or 81*a*. Further, simultaneously with correcting the tilted paper P, the aligning roller pair 65 aligns the leading edge of a toner image on the photosensitive drum 44 with the leading edge of the paper P. By this aligning, the paper P is conveyed to the transferring stage at the same speed as the moving speed of the peripheral surface of the photosensitive drum 44. At this side of the aligning roller pair 65, that is, the feed roller 64 side, there is an aligning sensor 66 provided to detect arrival of the paper P.

The paper supply cassette 57, the large volume paper feeder 55, the pick up roller 63, the feed rollers 64 and 81*a*, and the aligning roller pair 65 comprise a first paper supply means and also, the large volume paper feeder 55, the pick up roller 63, the feed roller 81*a* and the aligning roller pair 65 function as the paper supply means of the present invention.

In the transferring stage, a developer image, that is, a toner image formed on the photosensitive drum 44 is transferred onto the paper P by the transfer charger 48. The paper P with a toner image transferred is separated from the peripheral surface of the photosensitive drum 44 by the action of the separation charger 47 and the separation claw 49 and is conveyed to the fixing unit 60 via the conveyor belt 67 which comprises a part of the conveying path 58. Then, after the developer image is fused and fixed on the paper P by the fixing unit 60, the paper P is ejected on the receiving tray 62 through the exhaust port 61 by a feed roller pair 68 and an exhaust roller pair 69.

Figure 2:
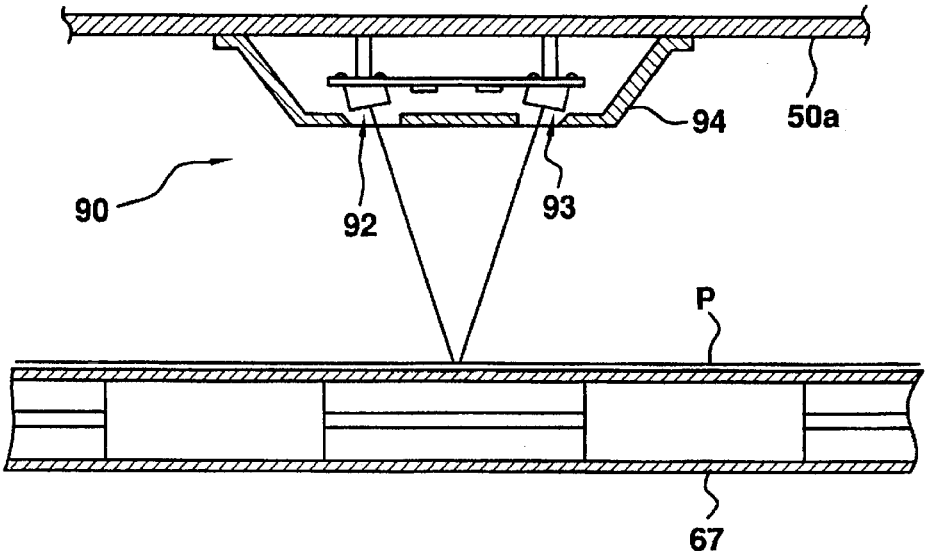
FIG. 2 is a sectional view showing the state of an Image density sensor mounted in the copying machine shown in FIG. 1.

Above the conveyor belt 67, there is an image density sensor 90 which functions as a detecting means to detect the density of the image transferred on the surface of the paper P. As shown in FIG. 2, the image density sensor 90 is fixed to a stay 50*a* which is positioned near the cleaning unit 50. The image density sensor 90 is comprised of a light emitting element 92 and a light receiving element 93. The light emitting element 92 comprises, for example, a photo-silicon diode, etc. and applies the detecting light to the center of the paper P being conveyed by the conveyor belt 67. The light receiving element 93 receives the reflecting light from the paper P and converting it to electric signals, inputs the converted signals to an image density detecting circuit 132, which will be described later. In order to be hardly affected by the outdoor daylight, the light emitting element 92 and the light receiving element 93 are covered by a cover 94.

As shown in FIG. 1, an image density sensor 91 in the same construction as the image density sensor 90 is provided between the large volume paper feeder 55 and the feed roller 81*a*. The image density sensor 91 is used to detect the density of an image formed on reuse paper, for instance, when reuse paper having an image already formed on its surface is loaded in the large volume paper feeder 55, is supplied to the image forming unit 6.

Under the conveying path 58, an automatic duplex device (hereinafter referred to as ADD) 70 is provided to invert the paper P passed through the fixing unit 60 and supply it again to the aligning roller pair 65. The ADD 70 is equipped with a temporary stacker 71 which stacks the paper P temporarily, a conveying path 72 which is branched from the conveying path 58 to lead the paper P passed through the fixing unit 60 to the temporary stacker 71, a plurality of conveyor rollers 76, a pick up roller 73 which picks up the paper P stacked in the temporary stacker one by one, and an inverting path 74 which inverts the picked up paper and leads them to the aligning roller pair 65. The temporary stacker 71 is provided with an empty detection switch 83 which detects the presence of the paper P.

The inverting path 74 is provided with a feed roller 75*a* to convey the paper P picked up by the pick up roller 73, a separation roller 75*b* which is rotatably contacting the feed roller 75*a*, an aligning roller pair 78 which aligns the leading edges of the paper P sent from the feed roller 75*a* and supplies the paper to the aligning roller pair 65 at a prescribed timing, and a paper stop switch 80 which is positioned between the feed roller 75*a* and the aligning roller pair 78 to detect the passage of the paper P. Further, a gate flapper 77 is provided at the branching portion of the conveying paths 58 and 72 to selectively divide the paper P to the exhaust port 61 or the conveying path 72.

Figure 3:
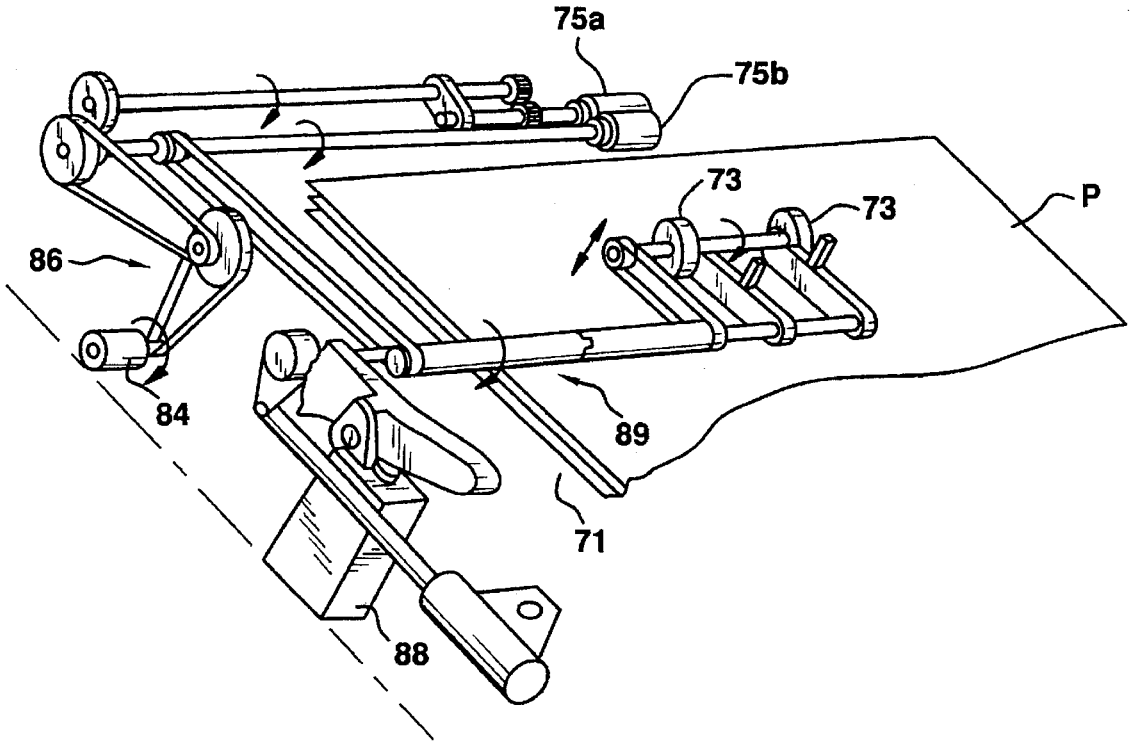
FIG. 3 is a perspective view showing a paper supply mechanism of an automatic duplex device in the copying machine shown in FIG. 1.

As shown in FIG. 3, the pick up roller 73 is connected to a swinging mechanism 89 which has a solenoid 88. The pick up roller 73 is oscillated by this swinging mechanism 89 between the pick up position which is in contact with the upper surface of the top paper P stacked in the temporary stacker 71 and the evacuating position separated away from the paper P.

Further, the feed roller 75*a* is provided at a position contacting the center of the top paper P picked up by the pick up roller 73. The feed roller 75*a*, the separation roller 75*b* and the pick up roller 73 are connected to a driving mechanism 86 which is a driving means having a driving shaft, a pulley, a motor for driving belt 84, etc. Both of the feed roller 75*a* and the pick up roller 73 are rotated in the same direction and the separation roller 75*b* is rotated in the opposite direction of the feed roller by the driving mechanism 86.

Figure 4:
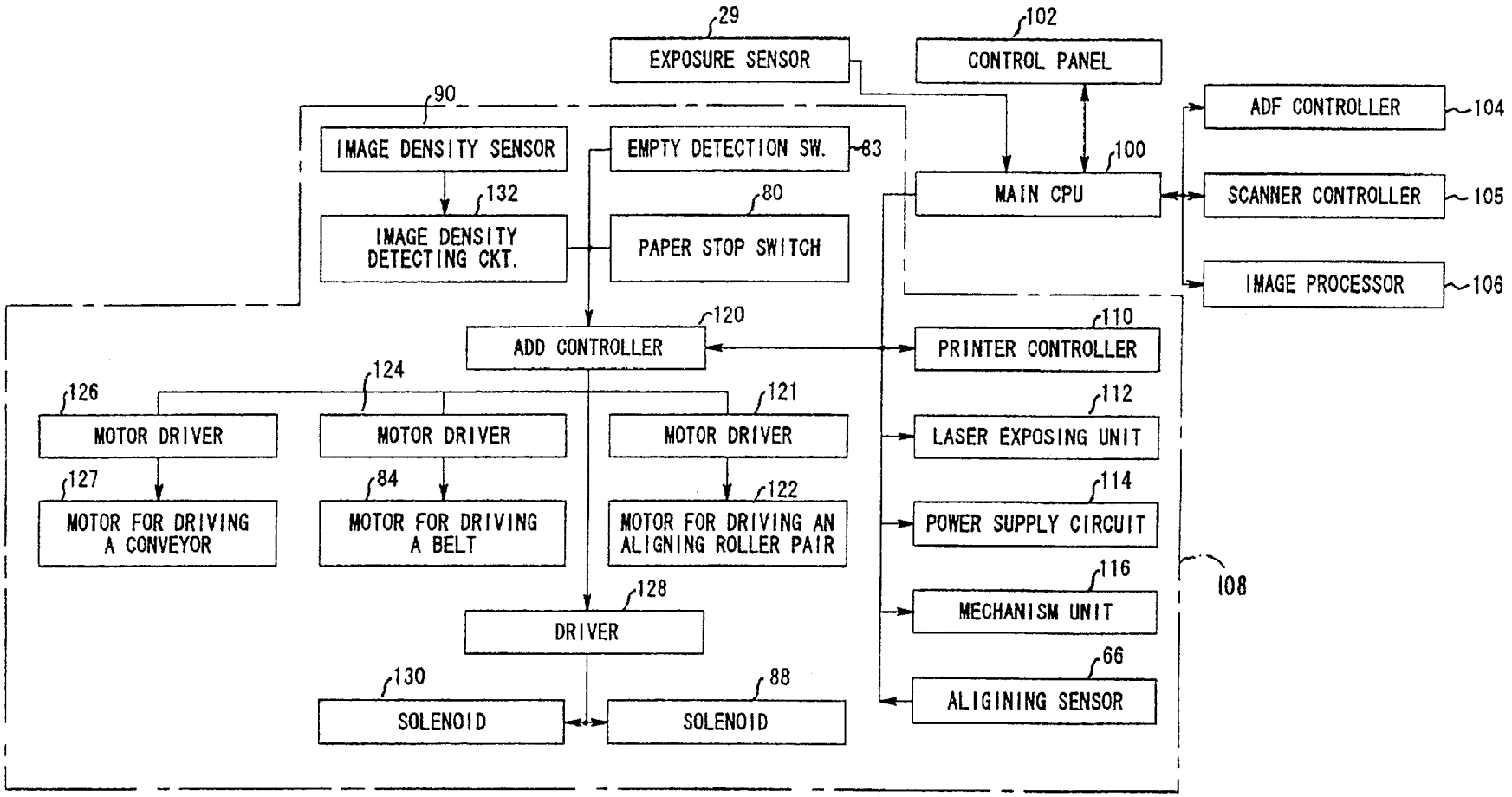
FIG. 4 is a block diagram showing a control mechanism in the copying machine shown in FIG. 1.

FIG. 4 schematically shows the construction of a control mechanism of a copying machine in the construction as described above. The control mechanism is equipped with a main CPU 100 which controls the operation of the entire copying machine. An ADF controller 104 to control the ADF 7, a scanner controller 105 to control the scanner 4, an image processor 106 to process image information which is read by the scanner 4, a control panel 102 and an exposure sensor 29 are connected to the main CPU 100.

Further, a printer portion 108 is connected to the main CPU. The printer portion 108 comprises a printer controller 110 to control the operation of the image forming unit 6, a laser exposing unit 112, a power supply circuit 114, a mechanical unit 116 such as a paper supply mechanism, conveying mechanism, etc., the aligning sensor 66 and an ADD controller 120 to control the ADD 70. The power supply circuit 114 supplies voltage to the main charger 45 of the image forming unit 6, the transfer charger 48 and the separation charger 47.

To the ADD controller 120, an image density detecting circuit 132 to detect the image density according to a detecting signal from the image density sensor 90, the paper stop switch 80 and the empty detection switch 83 are connected. Furthermore, motor drivers 121, 124 and 126 and a driver 128 are connected to the ADD controller 120. The motor driver 121 drives a motor for driving an aligning roller pair 122 which rotates the aligning roller pair 78. The motor driver 124 drives the motor for driving belt 84 of the driving mechanism 86. The motor driver 126 drives a motor for driving a conveyor 127 which rotates the conveyor rollers 76. The driver 128 drives a solenoid 130 which changes over the gate flapper 77 and the solenoid which rotates the pick up roller 93, respectively.

Next, the operation of a copying machine constructed as describe above when performing the copying of both sides; more particularly, the paper supply operation of the ADD 70 will be described in detail with reference to FIGS. 5 through 10.

First, the paper P is picked up from the paper supply cassette 57 by the pick up roller 63 and is supplied to the aligning roller pair 65 by the feed roller 64. After the leading edge is aligned, the paper P is supplied to the transferring stage at a prescribed timing and then, a toner image formed on the photosensitive drum 44 is transferred on the surface of the paper P in this transferring stage. The paper P with the toner image transferred is conveyed to the fixing unit 60 by the conveyor belt 67, where the toner image is fused and fixed on the surface of the paper P.

Figure 6:
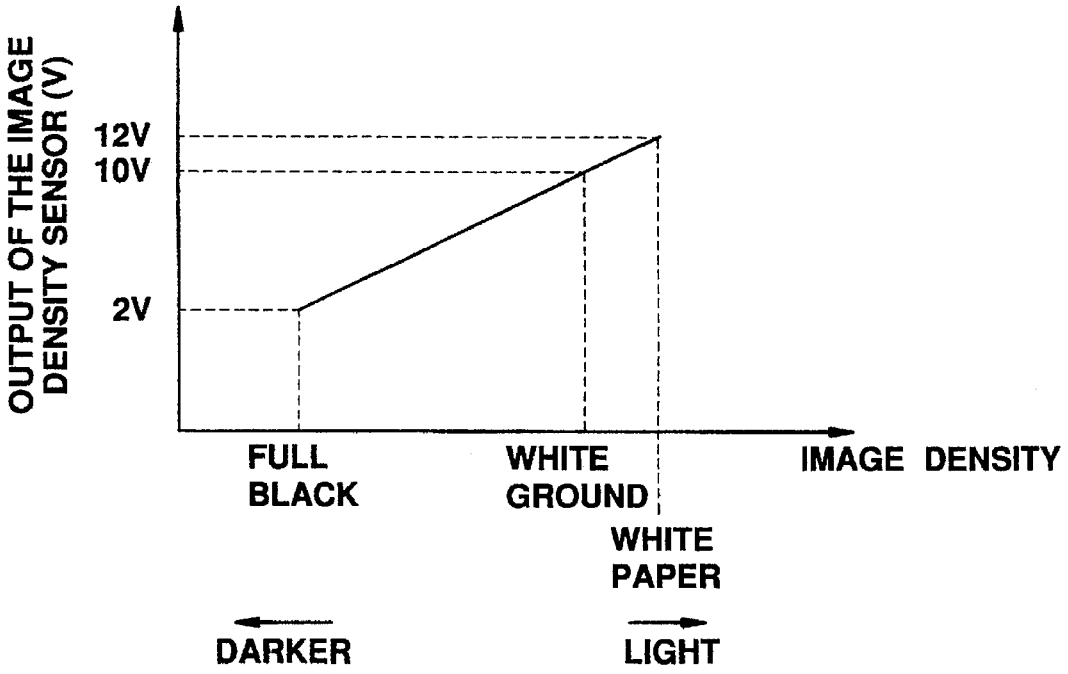
FIG. 6 is a graph showing the relation between the image density formed on a paper and the output of an image density sensor.

While the paper P is being conveyed by the conveyor belt 67, the image density of the toner image formed on the surface of the paper P is detected by the image density sensor 90. That is, the detecting light is emitted to the center of the surface of the paper P from the light emitting element of the image density sensor 90 and the reflecting light from the surface of the paper is received by the light receiving element 93. As shown in FIG. 6, if a toner image formed on the surface of the paper is an image on the white ground, the reflecting light quantity from the paper P is much and the detection output of the light receiving element 93 becomes large, accordingly. On the contrary., a toner image formed on the surface of the paper P is an image on a white ground in the density close to the full black, the reflecting light to quantity from the paper P is less and the detection output of the light receiving element 93 also becomes small. Then, the detection signal from the light receiving element 93 is input to the ADD controller 120 via the image density detecting circuit 132. The ADD controller 120 adjusts the paper supply conditions of the feed roller 75*a* of the ADD 70 corresponding to the input detection signal, that is, the image density.

Figure 7:
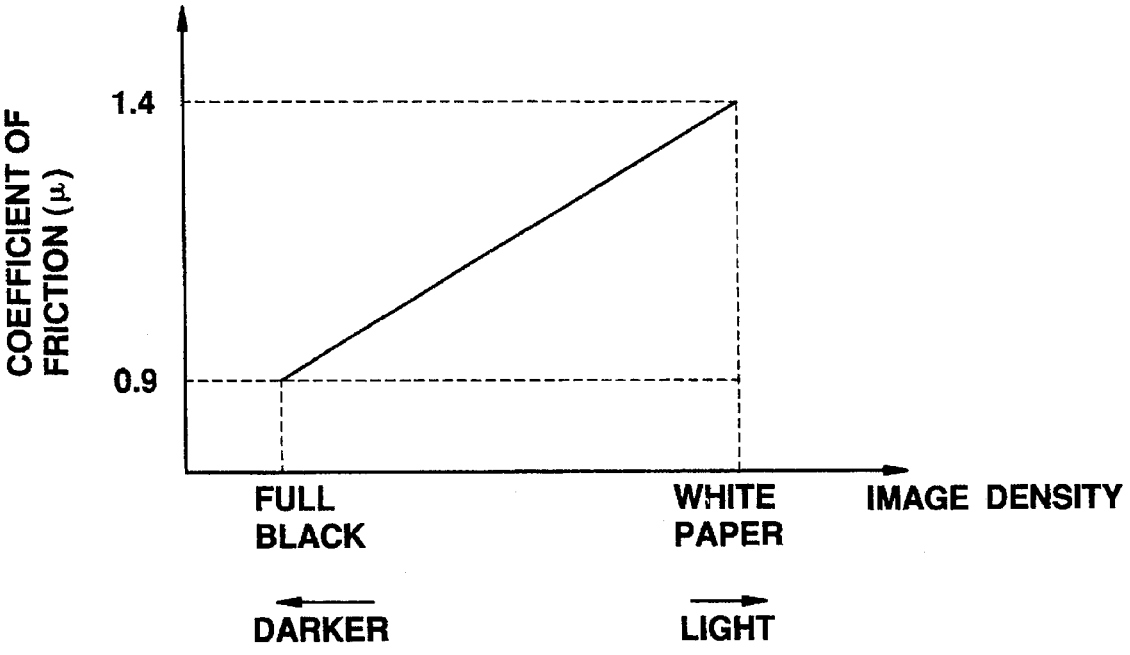
FIG. 7 is a graph showing the relation between the image density formed on a paper and the coefficient of friction.

FIG. 7 shows the relation between the density of an image formed on the surface of the paper P and the coefficient of friction of the surface of the paper and it can be seen that the more the image density is high, the more the coefficient of friction of the surface of paper becomes low.

On the other hand, the paper P passed through the fixing unit 60 is led to the conveying path 72 of the ADD 70 by the gate flapper 77 which is changed over to the inverting position. The paper P is conveyed to the temporary stacker 71 through the conveying path 72 by the conveyor rollers 76 and stacked in the temporary stacker 71 in the state with the surface having an image formed faced upward.

When the empty detection switch 83 detects the stack of the paper P, the pick up roller 73 is moved by the solenoid 88 to the pick up position where the pick up roller 73 is brought in contact with the surface of the paper P and almost at the same time, the motor 84 for driving a belt of the driving mechanism 86 is driven. As a result, the pick up roller 73, the feed roller 75*a* and the separation roller 75*b* are rotated and the paper P is taken cut of the temporary stacker 71 by the pick up roller 73. The taken out paper P is sent between the feed roller 75*a* and the separation roller 75*b*. The feed roller 75*a* supplies the paper P toward the aligning roller pair 78 in the state contacting the center of the surface of the paper P with an image formed. Here, the position of the paper P at where the feed roller 75*a* contacts the paper P is the center of the surface with an image formed and agrees with the position where the image density is detected by the image density sensor 90 as described above.

When a feeding time T was passed after the leading edge of the paper P being conveyed by the feed roller 75 was detected by the paper stop switch 80, the motor 84 is stopped and driving of the feed roller 75*a* is stopped. In the meantime, the paper P is conveyed by the feed roller 75*a* to the position where its leading edge contacts the aligning roller pair 78 and is aligned by this aligning roller pair 78.

Figure 8:
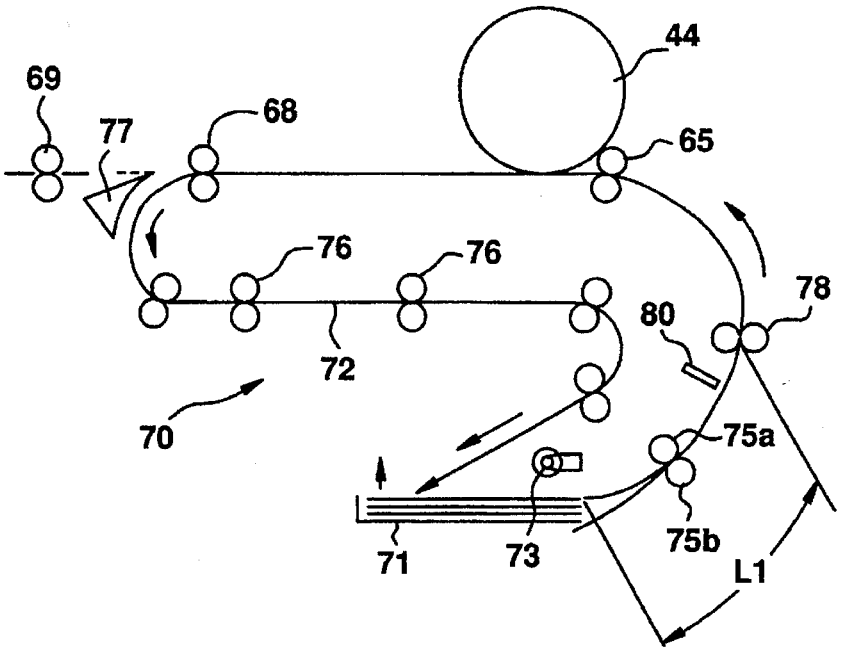
FIG. 8 is a schematic diagram showing the conveying route of a paper in the automatic duplex device.

As shown in FIG. 8, if a distance from the end of the temporary stacker 71 to the aligning roller pair 78 is assumed to be L1 and amount of aligning of the paper is ΔL, the feeding amount L of the paper P supplied from the feed roller 75*a* will become L=L1+ΔL. This aligning amount ΔL is determined by the feeding time T after the leading edge of the paper P was detected by the paper stop switch 80. If this feeding time T is too long, the aligning amount ΔL becomes large and the leading edge of the paper P deflects largely in front of the aligning roller pair 78 after contacting the aligning roller pair 78, causing the paper fold, transfer void and/or paper jamming. On the contrary, if the feeding time is too short, the aligning amount ΔL becomes insufficient and the leading edge of the paper P does not reach the aligning roller pair 78, causing the shift of the paper leading edge position and/or paper jamming. Further, as described above, the coefficient of friction between the surface of the paper P and the feed roller 75*a* changes according to the density of an image formed on the surface of the paper P and therefore, the aligning amount ΔL will change corresponding to the image density even when the feeding time T is constant.

Figure 9A:
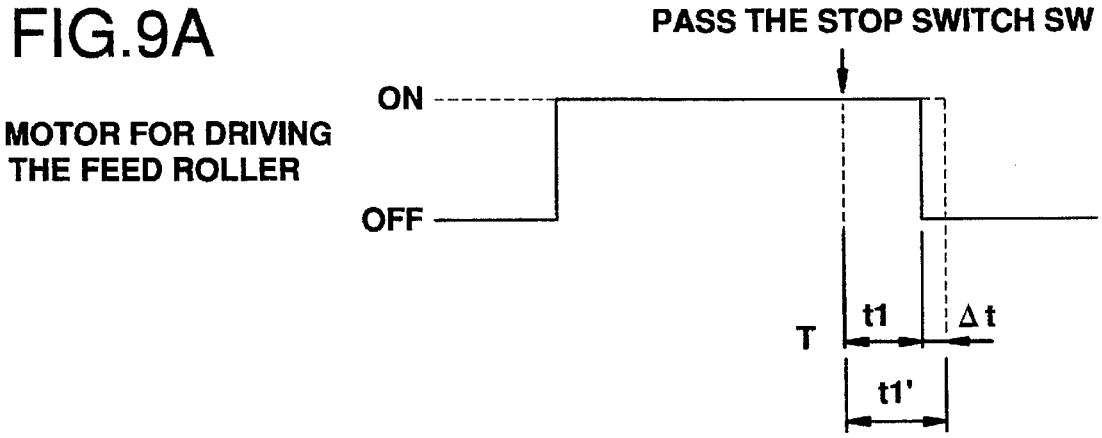
FIGS. 9A and 9B are timing charts showing the operating timings of a motor for driving a feed roller and a motor for driving an aligning roller in the automatic duplex device.
Figure 9B:
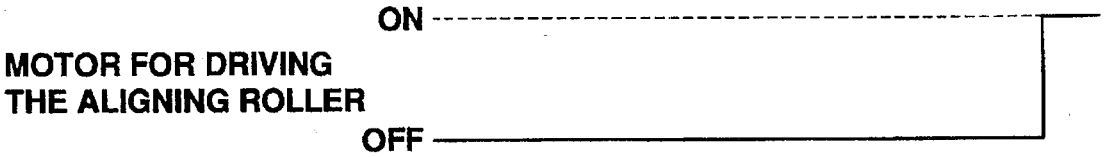
Figure 10:
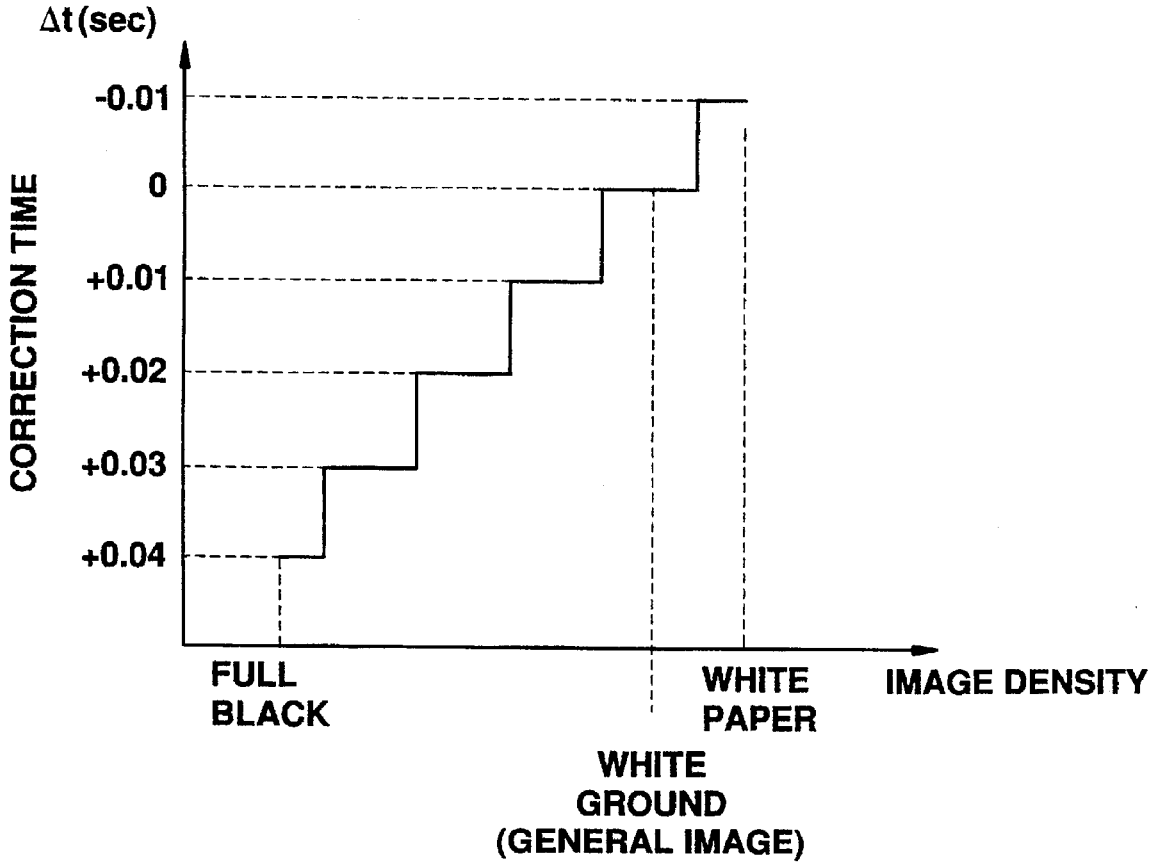
FIG. 10 is a graph showing the relation between the image density formed on a paper and a correction time of a feed roller driving time.

As shown in FIG. 9, according to this embodiment, assuming that the feeding time T is t1 when the image density on the surface of the paper P is a standard value (When an image was formed on the white ground and the detection output is 10 V in FIG. 6), if the image density on the surface of the paper P detected by the image density sensor 90 differs from this standard value, the feed roller 75*a* is driven by changing the feeding time T to t1' which is the standard time t1 plus a correction time Δt. For the correction time Δt, a prescribed value is set corresponding to the image density for every 0.01 second as shown in FIG. 10 and stored in the ADD controller 120 as the control data. The more the detected image density is higher than the standard value, the more this correction time Δt will become a large value at the plus side and the feeding time T will become larger than the standard time t1. On the contrary, the more the detected image density is lower than the standard value, the more the correction time Δt will become a large value at the minus side and the feeding time T will become shorter than the standard time t1. For instance, if the peripheral speed of the feed roller is 500 m/sec. and the process speed of a copying machine is 250 m/sec., the correction time Δt is set at about 0.04 sec. when the image density is a value corresponding to the full black. Here, the adjusting range of the correction time Δt is not limited to every 0.01 sec. but is changed according to a material of the feed roller 75*a*, degree of deterioration, quality of paper, etc.

Figure 11:
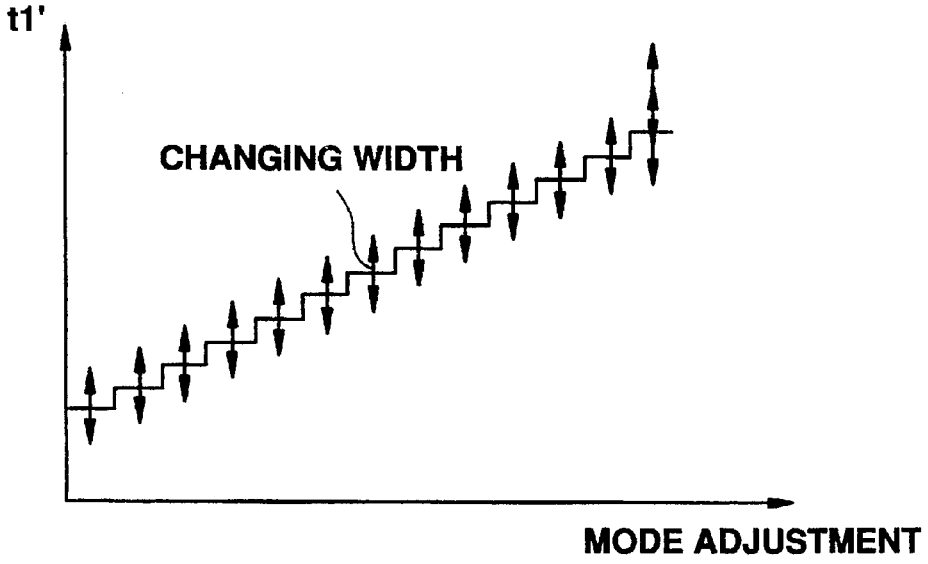
FIG. 11 is a graph showing the relation between the mode adjustment of a correction time of a feed roller driving time and a conveying time.

Further, as shown the staircase shaped solid line in FIG. 11, the standard value t1 of the feeding time T may be preset at a proper value before starting a copying machine according to an intrinsic error of a copying machine and working environmental conditions, etc. and in case of the copying machine of this embodiment, the set standard value is corrected in a prescribed rage according to the image density detected during the operation.

As described above, the ADD controller 120 compares the image density on the surface of the paper P detected by the image density sensor 90 with a standard value and if differing from the standard value, the feeding time T is changed to T=t1+Δt by computing a correction time Δt. Then, the ADD controller 120 starts to drive the feed roller 75*a* and after the feeding time T has passed after the leading edge of the paper P was detected by the paper stop switch 80, stops the feed roller 75*a* being driven. Thus, the paper P is supplied up to the aligning roller pair 78 by the feed roller 75*a* and aligned by the aligning roller pair 78.

As described above, after the paper P is aligned, the motor 122 is driven to rotate the aligning roller pair 78 to supply the paper P to the aligning roller pair 65. The paper P is further supplied to the transferring stage in the state where its back is facing the photosensitive drum 44. Then, after another image was transferred on the back of the paper P in the transferring stage, the paper P is ejected on the receiving tray 62 via the conveying path 58, the fixing unit 60 and the exhaust roller pair 69. Now, the double side copying operation is finished.

When performing a series of the double side copying using a plurality of original documents, for instance, an image to be formed on the surface of a first paper P corresponds to a first document, an image to be formed on the back of the first paper P corresponds to a second document, an image to be formed on the surface of a second paper P corresponds to the third document, an image to be formed on the back of the second paper P corresponds to a fourth document, an image to be formed on the surface of a third paper P corresponds to a fifth document, and an image to be formed on the back of the third paper P corresponds to a sixth document, respectively. That is, an image on an odd numbered document, namely (2n−1)th document (n: natural number) is formed on the surface of the paper, while an image on the even numbered document, namely (2n)th document (n: natural number) is formed on the back of the paper P.

Therefore, in the present invention, as the driving conditions of the feed roller 75*a* are adjusted in order to supply the paper P again to the image forming unit when forming an image on the back of the paper P, the image density on the paper P copied from an odd numbered document ((2n−1)th document) is detected by the image density sensor 90. When the paper P on which an image corresponding to a following even numbered document ((2n)th document) is to be formed is supplied again to the image forming unit, the driving condition of the feed roller 75*a*, that is, a driving time is adjusted in accordance with the density of the image formed on the paper P corresponding to an odd numbered document ((2n−1)th document).

Further, the adjustment of the driving condition described above is not limited to a method of adjustment performed based on the result of the image density detection of the paper P on which the image was formed corresponding to an odd numbered document ((2n−1)th document) but my be performed based on the detected result of the image density of an odd numbered document ((2n−1)th document) placed on the document table 12 or based on the printing rate of an odd numbered document ((2n−1)th document).

Further, when loading reuse paper P having an image formed on the surface in the large volume paper feeder and forming another image on the back of the reuse paper P supplied from the large volume paper feeder in a copying machine in the construction as described above, first detecting the image density on the surface of the reuse paper P by the image density sensor 91, the driving time of the feed roller 81*a* is adjusted according to a similar method as described above.

That is, if the detected image density is higher than the standard value, the driving time of the feed roller 81*a* is made longer by adding a plus correction time Δt to the standard time and if the detected image density is lower than the standard value, the driving time of the feed roller 81*a* is made short by adding the minus correction time Δt to the standard time. Thus, a fixed quantity of reuse paper P is supplied by the feed roller 81*a* without being affected by the image density on the surface of the reuse paper P and after accurately aligned by the aligning roller 65, the reuse paper is supplied to the transferring stage. After another toner image was transferred on the back of the reuse paper P in this transferring stage, the reuse paper P is ejected on the receiving tray 61 through the fixing unit 60.

In case of a copying machine in the construction as described above, when copying an image on the back of a paper having another image already formed on its surface by supplying it again from the ADD 70, the density of the image formed on the surface of the paper is detected in advance and a driving time of the feed roller 75*a* is adjusted according to the detected image density. Therefore, even when the coefficient of friction between a paper and the feed roller 75*a* changes in consonance with the change in the image density, it is possible to feed the paper with a prescribed feeding amount by the feed roller 75*a*. So, it is also possible to align the leading edges of paper at a fixed aligning amount by the aligning roller pair 78, thus preventing generation of transfer void, positional shift, paper jam, etc. caused from improper aligning.

Further, when performing the copying on the back of reuse paper P supplied from the large volume paper feeder 55, as a driving time of the feed roller 81*a* is adjusted according to the image density formed on the surface, it is possible to align the leading edges of the paper P at a fixed aligning amount by the aligning roller pair 65 without being affected by the change in the coefficient of friction likewise the above, thus preventing generation of transfer void, shift of position, paper jam, etc.

In the embodiment described above, when forming an image on the back of the paper P, the image density formed on the surface of the paper P is detected and a driving time of the feed roller to feed the paper P to the image forming unit again is adjusted according to the detected image density.

However, instead of the image density on the surface of the paper P, a driving time of the feed roller to feed the paper P to the image forming unit may be adjusted by detecting the image density of a document D placed on the document table 12 and according to the detected density when forming an image on the back of the paper P. That is, the density detecting step in the flowchart shown in FIG. 5 is used for detecting the image density of a document D.

Figure 12:
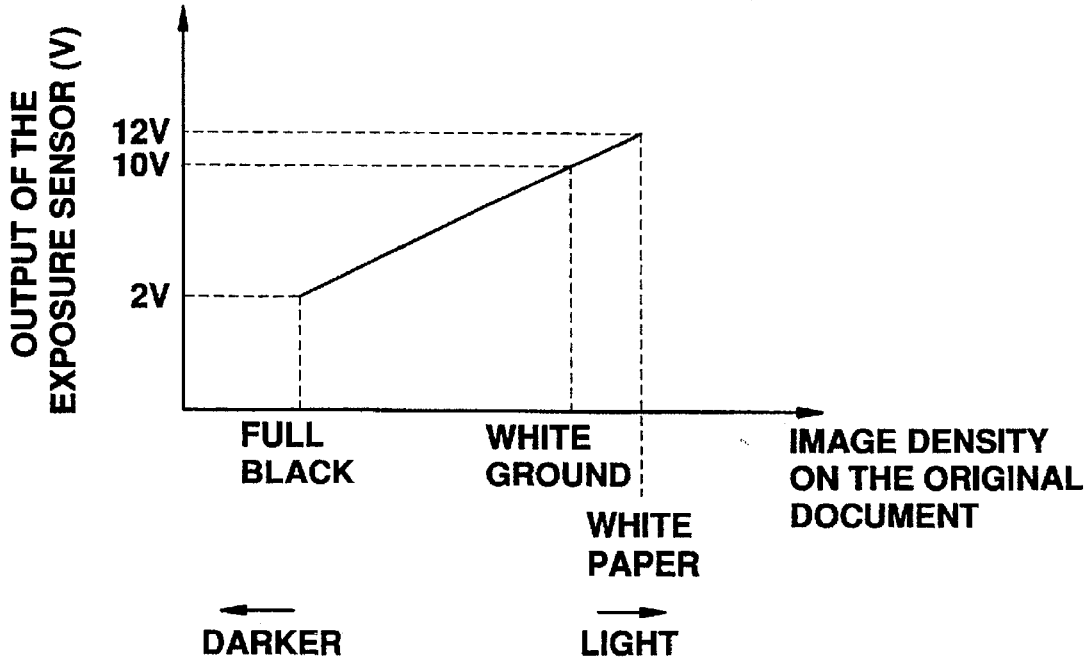
FIG. 12 is a graph showing the relation between the image density on a document and the output of an exposing sensor.

To detect the image density of a document D, the exposure sensor 29 is attached to the first carriage 27 as shown in FIG. 1. The exposure sensor 29 is arranged at the position where the reflecting light from the document D lead by the first mirror 26 can be partially received. So far, a so-called automatic exposure control is carried out to get a copy in the proper density regardless of the image density of the document D by controlling the brightness of the light source 25 based on the output signal from the exposure sensor 29. In this embodiment a driving time of the feed roller to feed the paper P to the image forming unit again is adjusted when forming an image on the back of the paper P using the output signal from the exposure sensor 29 obtained in this automatic exposure control. In case of a white paper without any image and character on a document D as shown in FIG. 12, the reflecting light quantity is much and voltage of 3 V is output from the exposure sensor 29 which received the reflecting light. Therefore, the more a document D has an image on much white ground, the more the detection output voltage from the exposure sensor 29 becomes large. On the contrary, the reflecting light quantity from a document D which has a fully black image is less and the detection output voltage from the exposure sensor 28 becomes small. Then, the detection output signal from the exposure sensor 29 is input to the ADD controller 120 through them in CPU 100 as shown in FIG. 4. The ADD controller 120 adjusts the paper feed condition of the feed roller 75*a* of the ADD 70 corresponding to the input detection signal, that is, the image density of the document D as described above.

Figure 5:
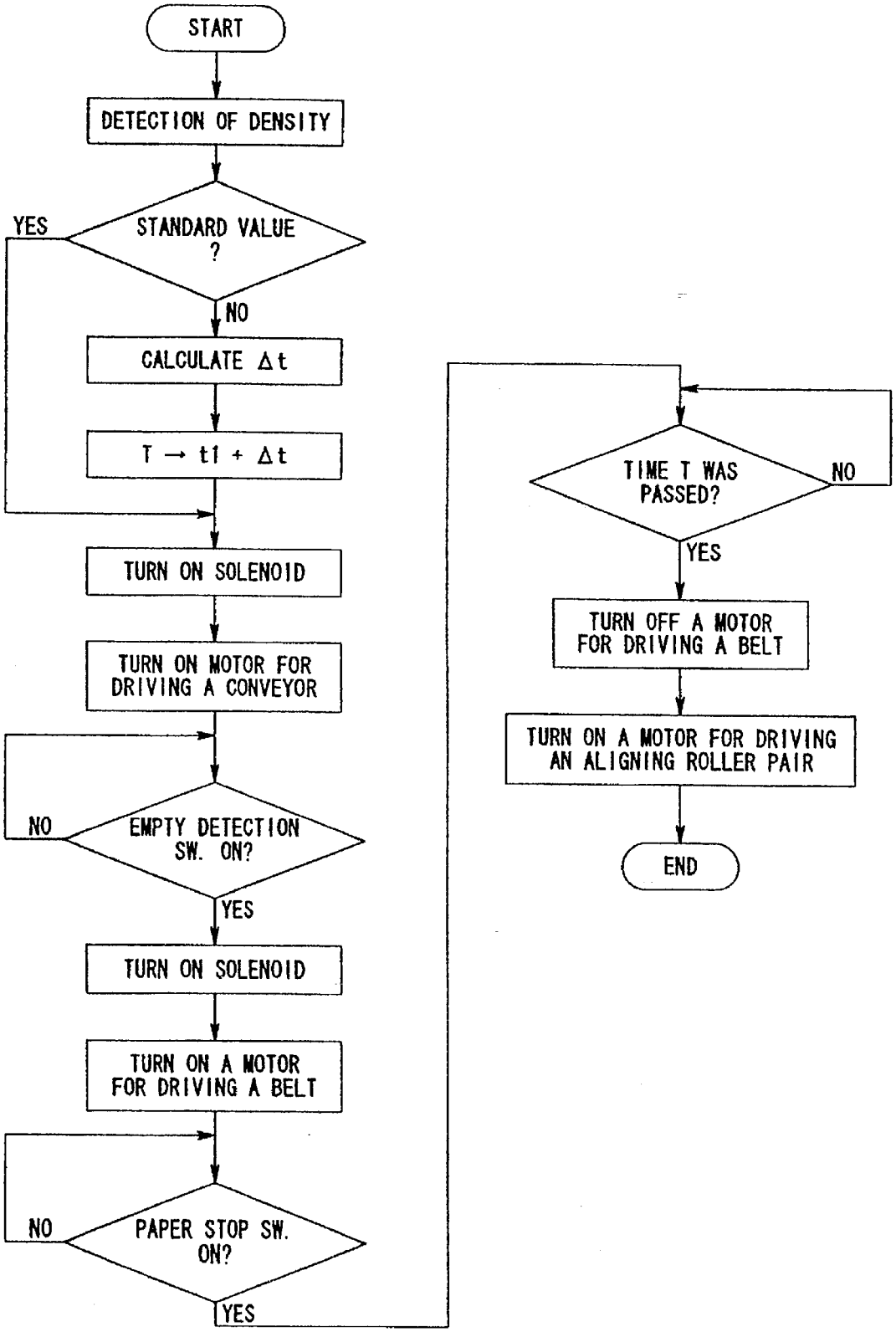
FIG. 5 is a flowchart showing the paper supply operation of the automatic duplex device.

Further, as another embodiment there is a method to carry out the density detection steps in the flowchart shown in FIG. 5 using a printing rate. This printing rate is defined that when the entire paper P is printed fully black, it is to be 100% and when nothing is printed on the entire paper P, it is to be 0%. As a copying machine to which this embodiment is applicable controls the light emission of the semiconductor laser 41 using a digital signal, a printing rate is computed according to the amount of data corresponding to the digital signal. That is, as the printer controller 110 controls the laser exposing unit 112 according to the digital data supplied from the main CPU 100, a printing rate is detected by the main CPU 100 based on this digital data. The data relative to this printing rate is also supplied to the ADD controller 120. The ADD controller 120 adjusts the paper feed condition of the feed roller 75*a* of the ADD 70 according to the supplied data relative to the printing rate. That is, the ADD controller 120 adjusts a driving time of the feed roller 75*a* to supply the paper P again to the image forming unit when forming an image on the back of the paper P.

Figure 13:
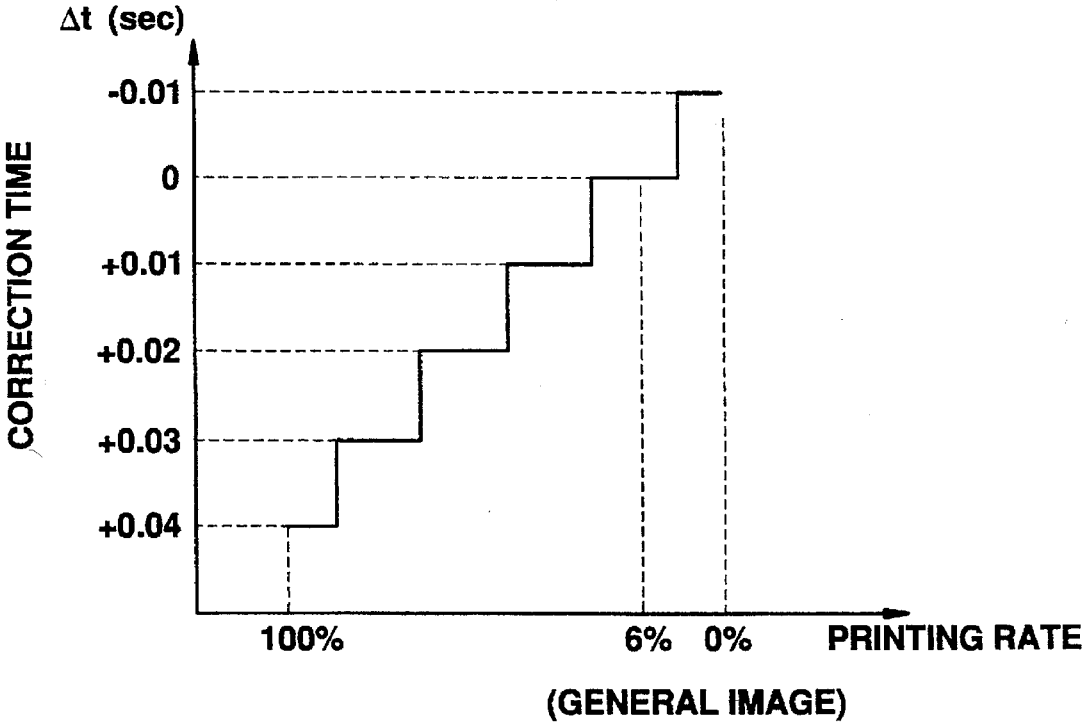
FIG. 13 is a graph showing the relation between a printing rate and a correction time of a feed roller driving time.

As shown in FIG. 13, a prescribed value is set for the correction time Δt according to the printing rate for every 0.01 sec. likewise FIG. 10 and stored in the ADD controller 120 as the control data. The more a supplied printing rate is higher than the standard value, the more this correction time Δt becomes a large value at the plus side and a feed time T becomes longer than the standard time t1. On the contrary, the more a supplied printing rate is lower than the standard value, the more the correction time Δt becomes a large value at the minus side and the feed time T becomes shorter than the standard time t1. For instance, if the peripheral speed of a feed roller is 500 mm/sec., the process speed of a copying machine is 250 mm/sec. and a printing rate is a value corresponding to the full black, the correction time Δt is set at about 0.04 sec. Here, the adjusting range of the correction time Δt is not limited to every 0.01 sec. but is changeable according to a material as well as degree of deterioration of the feed roller 75*a*, quality of paper, etc.

Further, the present invention is not limited to the embodiment described above but may be embodied in various forms without departing from the spirit and scope thereof. For instance, in the embodiment described above, a paper supply condition of the feed roller and a driving time of the feed roller are adjustable according to the image density formed on a paper, the image density on an original document, a printing rate, etc. However, not limiting to a driving time, a rotational speed of a feed roller may be adjusted according to the image density on a paper and a printing rate of the image density on an original document. Even in this case, the same effect as in the embodiment described above can be obtained.

Figure 14:
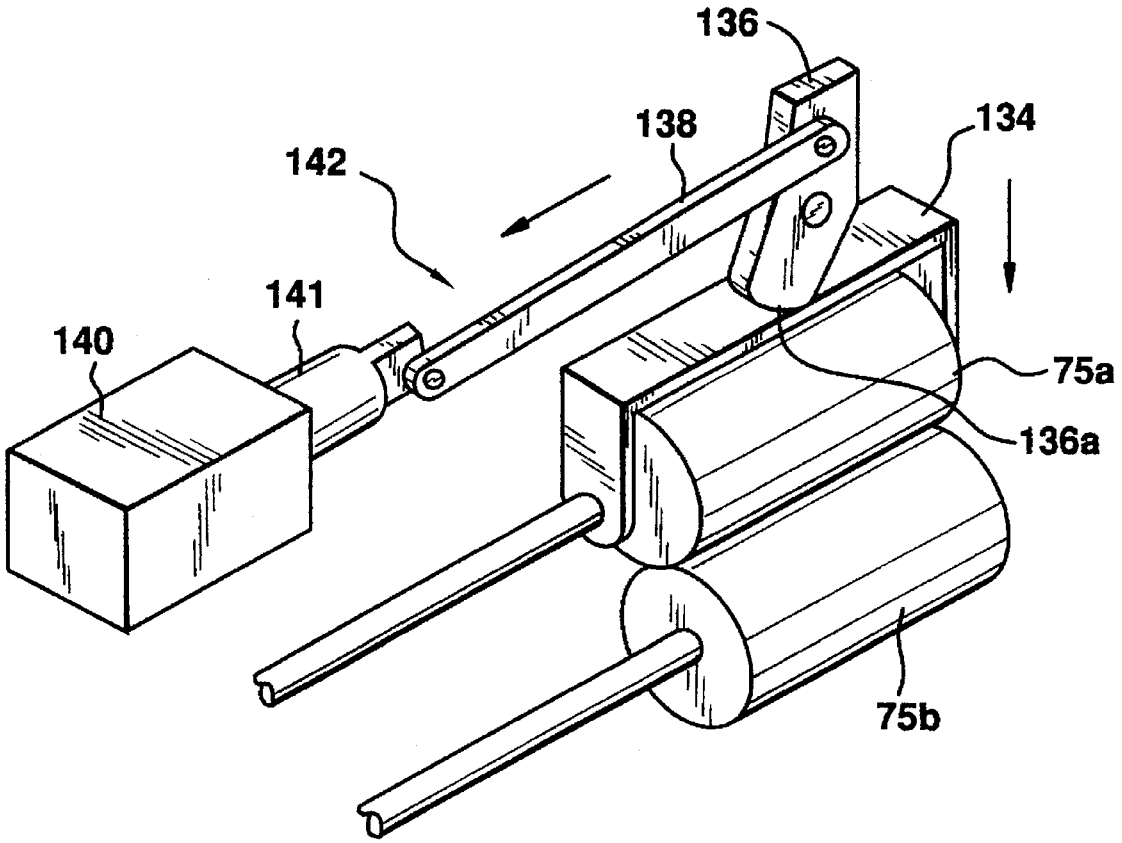
FIG. 14 is a perspective view showing a contacting pressure adjusting mechanism of the feed roller involved in a deformed embodiment of the present invention.

Further, as a paper feed condition, a contacting pressure of the feed roller against a paper may be made adjustable according to the image density and a printing rate. In this case, for instance, the ADD 70 is constructed by providing an adjusting mechanism 142 to adjust the pushing force of the feed roller 75*a* against the separation roller 75*b* as shown in FIG. 14. This adjusting mechanism 142 has a pusher plate 134 attached to the rotary shaft of the feed roller adjacent to the feed roller 75*a* and a surface 136*a* of cam member which is contacting the pusher plate 134 and is equipped with a rotatably supported cammember 136 and a solenoid 140 having a plunger 141 connected to the cammember 136 via a connecting rod 138.

When the solenoid 140 is excited in the direction to pull in the plunger 141, the cam member 136 is rotated counterclockwise via the connecting rod 138 and the pusher plate 134 is pushed downward, that is, toward the separation roller 75*b* by the surface 136*a* of the cam member 136. As a result, the pushing force of the feed roller 75*a* against the separation roller 75*b* increases and furthermore, the contacting pressure of the feed roller 75*a* against a paper passing between these rollers increases. On the contrary, when the solenoid 140 is excited in the direction where the plunger 141 is projected, the cammember 136 is rotated clockwise and the pushing force of the feed roller 75*a* against the separation roller 75*b* decreases. As a result, the contacting pressure of the feed roller 75*a* against a paper passing these rollers decreases.

Then, by adjusting the contacting pressure of the feed roller 75*a* according to the detected image density under the control of the ADD controller 120, that is, by increasing the contacting pressure if the image density is high and by decreasing the contacting pressure if the image density is low, it is possible to maintain always a constant feeding amount.

Further, the present invention is not limited to a copying machine but may be applicable to other image forming apparatus such as printer, etc.

As described above in detail, according to the present invention, it is possible to form a satisfactory image on the back of an image receiving medium without being affected by the image density formed on the surface by adjusting the feeding condition by the feed roller by detecting the image density formed on the surface in advance and by adjusting the feeding condition by the feed roller according to the detected image density when forming another image on the back of the image receiving medium with an image already formed on its surface.

In addition, according to the present invention it is possible to form a satisfactory image on the back of a image receiving medium without being affected by the image density formed on its surface by detecting the image density on a document in advance and by adjusting the feeding condition by the feed roller according to the detected image density when forming another image on the back of the image receiving medium with an image already formed on its surface.

Further, according to the present invention, it is possible to form a satisfactory image on the back of a image receiving medium without being affected by the image density formed on its surface by adjusting the feeding condition by the feed roller according to a printing rate when forming another image on the back of an image receiving medium with an image already formed on its surface.

What is claimed is:

1. An image forming apparatus comprising:

means for forming an image on an image receiving medium which has a first and a second surface;

roller means for conveying the image receiving medium on which the image was formed on the first surface to the image forming means again, the roller means contacting at least the first surface of the image receiving medium;

means for driving the roller means;

means for detecting the density of the image formed on the first surface of the image receiving medium; and means for adjusting the driving conditions of the roller means by the driving means according to the image density detected by the detecting means.

2. An image forming apparatus as claimed in claim 1 further comprising a path for guiding the image receiving medium with an image formed on the first surface by the image forming means, wherein the detecting means is provided on the path to detect the image density on the first surface of the image receiving medium which is conveyed through the path.

3. An image forming apparatus as claimed in claim 1 further comprising means for storing a plurality of image receiving media with images formed on first surfaces only, wherein the detecting means is provided near the storing means to detect the image density on a first surface while the image receiving media are conveyed from the storing means to the image forming means by the roller means.

4. An image forming apparatus as claimed in claim 1, wherein the adjusting means includes means for adjusting a driving time of the roller means.

5. An image forming apparatus as claimed in claim 1, wherein the roller means includes a roller and adjusting means includes means for adjusting a rotational speed of the roller means.

6. An image forming apparatus as claimed in claim 1, wherein the adjusting means includes means for adjusting the contacting pressure of the roller means against the image receiving medium.

7. An image forming apparatus comprising:

means for supporting a first document which has a first image and a second document which has a second image;

means for detecting an image density of the first image on the first document;

means for forming an image corresponding to the first image on a first surface of an image receiving medium and an image corresponding to the second image on a second surface of the image receiving medium, respectively;

a roller for conveying the image receiving medium on which the image corresponding to the first image was formed on the first surface to the image forming means again, the roller contacting at least the first surface of the image receiving medium;

means for driving the roller; and means for adjusting the driving conditions of the roller by the driving means according to the image density of the first image detected by the detecting means.

8. An image forming apparatus as claimed in claim 7, wherein the adjusting means includes means for adjusting a driving time of the roller.

9. An image forming apparatus as claimed in claim 7, wherein the adjusting means includes means for adjusting a rotational speed of the roller.

10. An image forming apparatus as claimed in claim 7, wherein the adjusting means includes means for adjusting the contacting pressure of the roller against the image receiving medium.

11. An image forming apparatus comprising:

means for forming an image on an image receiving medium which has a first and a second surfaces;

means for detecting a printing rate of an image formed on the first surface of the image receiving medium;

a roller for conveying the image receiving medium on which the image was formed on the first surface to the image forming means, the roller contacts at least the first surface of the image receiving medium;

means for driving the roller; and means for adjusting the driving condition of the roller by the driving means according to the printing rate of the image detected by the detecting means.

12. An image forming apparatus as claimed in claim 11 further comprising means for temporarily storing the image receiving medium with the first surface facing upward, on which the image was formed by the image forming means.

13. An image forming apparatus as claimed in claim 11, wherein the adjusting means includes means for adjusting a driving time of the roller.

14. An image forming apparatus as claimed in claim 11, wherein the adjusting means includes means for adjusting a rotational speed of the roller.

15. An image forming apparatus as claimed in claim 11, wherein the adjusting means includes means for adjusting the contacting pressure of the roller against the image receiving medium.

16. An image forming apparatus comprising:

means for supporting a plurality of original documents;

means for feeding successively the original documents from the supporting means;

means for detecting the image density of the image on the original document;

means for forming an image corresponding to the (2n–1)th original document fed by the feeding means on the first surface of an image receiving medium and an image corresponding to the (2n)th original document fed by the feeding means on the second surface of the image receiving medium (n: natural number);

means for conveying the image receiving medium formed the image of the (2n–1)th document on the first surface thereof to be formed the image of the (2n)th document on the second surface thereof to the image forming means again; and means for adjusting ability of the means for conveying the image receiving medium in accordance with the detection result of the density of the (2n–1)th document detected by the detecting means when the conveying means conveys the second surface of the image receiving medium to the image forming means.

17. An image forming apparatus as claimed in claim 16, wherein the detecting means includes an exposure sensor arranged below the supporting means.

18. An image forming apparatus as claimed in claim 16, wherein the adjusting ability means includes means for adjusting a driving time of a roller contacting with the image receiving medium.

19. An image forming apparatus as claimed in claim 18, wherein the adjusting means includes means for adjusting rotational speed of the roller.

20. An image forming apparatus as claimed in claim 18, wherein the adjusting means includes means for adjusting the contacting pressure of the roller against the image receiving medium.

* * * * *